US006530709B1

(12) United States Patent
Washington

(10) Patent No.: US 6,530,709 B1
(45) Date of Patent: Mar. 11, 2003

(54) NAIL POLISH APPLICATOR

(76) Inventor: Pamela D. Washington, P.O. Box 12972, Charleston, SC (US) 29422

( * ) Notice: Subject to any disclaimer, the term of this patent is extended or adjusted under 35 U.S.C. 154(b) by 0 days.

(21) Appl. No.: 09/727,033

(22) Filed: Nov. 30, 2000

(51) Int. Cl.[7] ..... A46B 11/04

(52) U.S. Cl. ..... 401/272; 401/270; 401/112; 401/117; 401/278

(58) Field of Search ..... 401/272, 270, 401/99, 112, 117, 268, 275, 278, 279, 282

(56) References Cited

U.S. PATENT DOCUMENTS

| | | | | | |
|---|---|---|---|---|---|
| 2,547,287 | A | * | 4/1951 | Sanders et al. | 401/99 |
| 3,655,290 | A | | 4/1972 | Griffith | |
| 3,739,789 | A | | 6/1973 | Cataneo et al. | |
| 4,063,829 | A | | 12/1977 | La Mura | |
| 4,447,169 | A | | 5/1984 | Vartoughian | |
| 4,594,014 | A | | 6/1986 | Korper | |
| 4,625,741 | A | | 12/1986 | Gardiner | |
| 4,640,637 | A | | 2/1987 | Winthrop | |
| 4,726,386 | A | | 2/1988 | Schultz | |
| 4,768,529 | A | | 9/1988 | Mahruki | |
| 4,838,722 | A | | 6/1989 | Katz | |
| 4,927,282 | A | | 5/1990 | Morane et al. | |
| 4,946,302 | A | | 8/1990 | Uchida | |
| 4,955,745 | A | | 9/1990 | Vauquelin | |
| 5,035,525 | A | | 7/1991 | Konose | |
| 5,092,702 | A | * | 3/1992 | Kurokawa | 401/278 |
| 5,123,766 | A | * | 6/1992 | Babiak | 401/278 |
| 5,397,195 | A | * | 3/1995 | Goncalves | 401/277 |
| 5,716,104 | A | | 2/1998 | Keating et al. | |
| 5,735,623 | A | | 4/1998 | Gueret | |
| 6,174,099 | B1 | | 1/2001 | Patel et al. | |

* cited by examiner

*Primary Examiner*—David J. Walczak
(74) *Attorney, Agent, or Firm*—Kathleen M. Harleston; Harleston Law Firm LLC

(57) ABSTRACT

An elongated, all-in-one applicator for dispensing and applying liquid nail polish includes:

(a) an elongated, hollow, generally pen-shaped main housing having an aperture at one axial extremity;

(b) an elongated cartridge housing disposed within an upper portion of the main housing;

(c) at least one nail polish cartridge comprising a central chamber for holding a supply of liquid nail polish, the nail polish cartridge having a first, upper end and an opposite, second, lower end, the cartridge being disposable within the cartridge housing;

(d) a brush having a plurality of bristles for applying nail polish, each bristle having a first end mounted in the main housing and an opposite, second end which is a free end;

(e) a mechanism for dispensing nail polish from the nail polish cartridge in increments, the nail polish dispensing mechanism having a first position in which nail polish is contained within the cartridge and is not dispensed, and a second position in which nail polish is dispensed from the cartridge through the housing aperture onto the brush; and (f) a mechanism for controlling the discharge of nail polish from the nail polish cartridge onto the brush.

14 Claims, 9 Drawing Sheets

NAIL POLISH APPLICATOR

BACKGROUND OF THE INVENTION

1. Technical Field

The present device is an all-in-one applicator for dispensing increments of liquid nail polish from a cartridge inside the applicator onto a brush at the bottom of the applicator for quick and easy polishing of fingernails or toenails.

2. Background Information

Generally, nail polish is supplied in small bottles and applied with a brush that is attached to the bottle's screw-on cap. Oftentimes, one or more of the ingredients in nail polish which has,not been used for awhile settle out of solution, so the user must invert or shake the bottle prior to use. To apply nail polish, the user removes the cap, dips the brush back into the polish, and wipes one side of the brush along the side of the neck of the nail polish bottle. When additional polish is needed, the user dips the brush back into the bottle of polish, wipes off one side of the brush, and again applies the polish on the brush to their nails. Application of nail polish in this manner requires the use of two hands and repeated trips to the bottle of nail polish. When applying polish to the user's own fingernails, this requires using the hand with recently applied polish, and risking contact with the bottle or nearby objects that may smear the recently applied polish. When this happens, the nail polish on the smeared nail must be removed and reapplied. For professional nail technicians, repeat trips to the bottle of polish and wiping off one side of the brush takes time and increases the cost of doing business and therefore the prices charged to the customer.

Also, small nail polish bottles are easily tipped over and brushes are frequently dropped on the way to or from the bottle. Young girls are fond of painting their nails and frequently end up accidentally spilling hard-to-clean nail polish on furniture, clothing, bedspreads, carpet, etc.

Currently, liquid nail polish is formulated to dry quickly upon application to enable the wearer to resume normal activities as soon as possible. The additional time required for repeated trips to the bottle of polish unfortunately allows the nail polish in the open bottle to dry out. Polish which has been open too long or is old tends to thicken, making future applications more difficult. In addition, nail polish coated along the neck of the bottle, and on the top of brush bristles when they remain above the level of polish in the bottle, tends to harden during storage. This dried polish interferes with future applications of polish and with closure of the bottle when a polishing job is finished. Sometimes it is necessary to dispose of a bottle of nail polish which is only partially empty because the remaining polish is too thick or the bottle is too difficult to reopen.

The present invention allows a user to apply drops of polish on an applicator brush from a reservoir of polish that is not exposed to air. The nail polish applicator of the present invention avoids wasting nail polish, is more efficient, and saves time and money. With the present invention, there is no need for a user to have multiple, partially filled old nail polish bottles lying around. Since there is no stockpile of old bottles to use up, up-to-date polish colors can be purchased without guilt as fashion changes. The applicator of the present invention eliminates the need for repeated trips to the bottle of nail polish and the need to wipe clear one side of the brush on the neck of the bottle.

BRIEF SUMMARY OF THE INVENTION

The present invention is an elongated, all-in-one applicator for dispensing and applying liquid nail polish or the like. This applicator includes:

(a) an elongated, hollow, generally pen-shaped main housing having an aperture at one axial extremity;

(b) an elongated cartridge housing disposed within an upper portion of the main housing;

(c) at least one, most preferably one, nail polish cartridge comprising a central chamber for holding a supply of liquid nail polish, the nail polish cartridge having a first, upper end and an opposite, second, lower end, the cartridge being disposable within the cartridge housing;

(d) a brush having a plurality of bristles for applying nail polish, each bristle having a first end mounted in the main housing and an opposite, second end which is a free end;

(e) a mechanism for dispensing nail polish from the nail polish cartridge in increments, the nail polish dispensing mechanism having a first position in which nail polish is contained within the cartridge and is not dispensed, and a second position in which nail polish is dispensed from the cartridge through the housing aperture onto the brush; and (f) a mechanism for controlling the discharge of nail polish from the nail polish cartridge onto the brush, the discharge mechanism comprising a button or lever accessible to a user.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
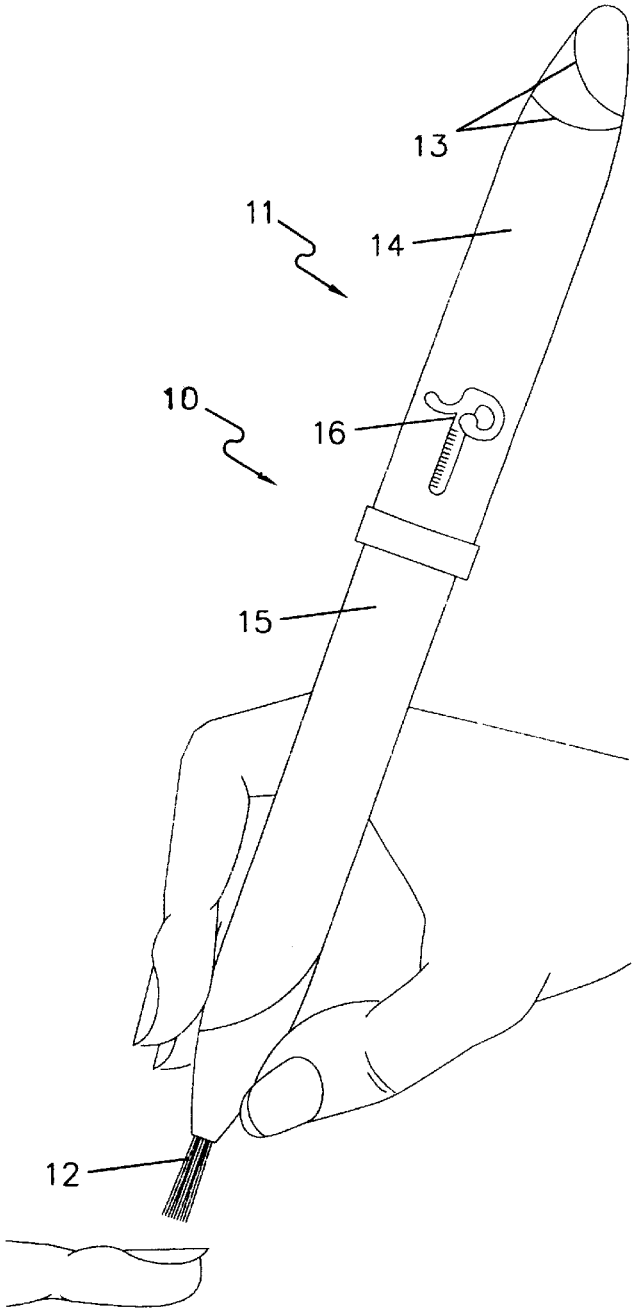
FIG. 1 is a perspective view of a nail polish applicator according to the present invention.

In the following description, like reference characters designate like or corresponding parts throughout the several views. Also, in the following description, it is to be understood that such terms as "upper," "lower," "front," "within," and the like are words of convenience and are not to be construed as limiting terms. Referring in more detail to the drawings, the invention will now be described.

Figure 2:
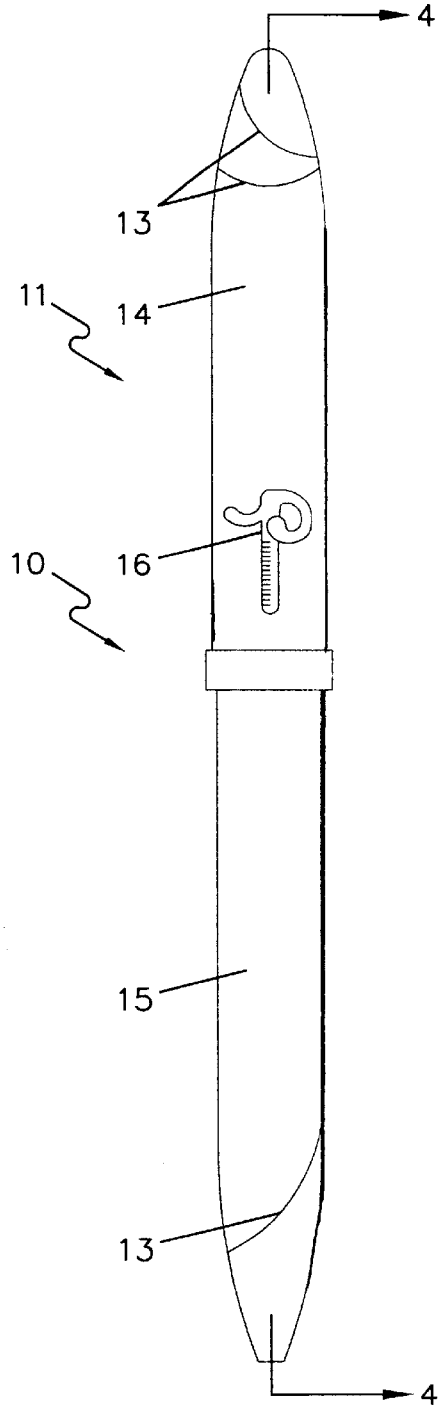
FIG. 2 is a front elevational view of a nail polish applicator according to the present invention.

Turning first to FIGS. 1 and 2, an elongated applicator, designated generally as 10, comprises a main housing 11 and a brush 12. FIG. 1 shows a preferred embodiment of this all-in-one nail applicator 10, which is generally in the form of a fountain pen, being used to apply nail polish to the surface of a fingernail. A user can hold the applicator in one hand while applying polish to the fingernails of the other hand, or it can be held by one person, such as a manicurist, who is applying polish to the fingernails of a second person. The applicator is preferably for use in applying nail polish, although it can be used to apply other fluids of generally similar viscosity, such as gels, acrylics, paint, or glue.

The main housing 11 can be decorated with design swirls or other embellishments 13 embossed on, or depressed into, the housing. In FIG. 2, the swirls at the upper and lower ends of the main housing are examples of such embellishments 13.

The main housing 11 is comprised of an elongated upper housing section 14 having an opening at one axial extremity, and a lower housing section 15 having an opening at one axial extremity, the upper and lower housing sections 14, 15 being detachably joined together at the openings, as shown in FIGS. 1 and 2. Preferably, the upper housing section has small, vertically oriented ribs on the inside that fit between the ribs on the outside of the cartridge housing. The ribs support each other when the housings are turned. The upper housing section 14 in the preferred embodiment shown in FIGS. 1 and 2 comprises a designer logos or emblem, here a stylized letter "P" 16.

The applicator of the present invention is a compact, neat, and convenient way to deliver nail polish. It avoids the need to repeatedly dip a nail polish brush into a nail polish container, move the brush over to the nail to be painted, move the brush back to the supply, insert it in the nail polish container and seal it. In the present invention, the brush and polish bottle are in one unit, hence, it is an "all-in-one" applicator. It can be used by nail professionals or lay users, and by the young or old.

Figure 3:
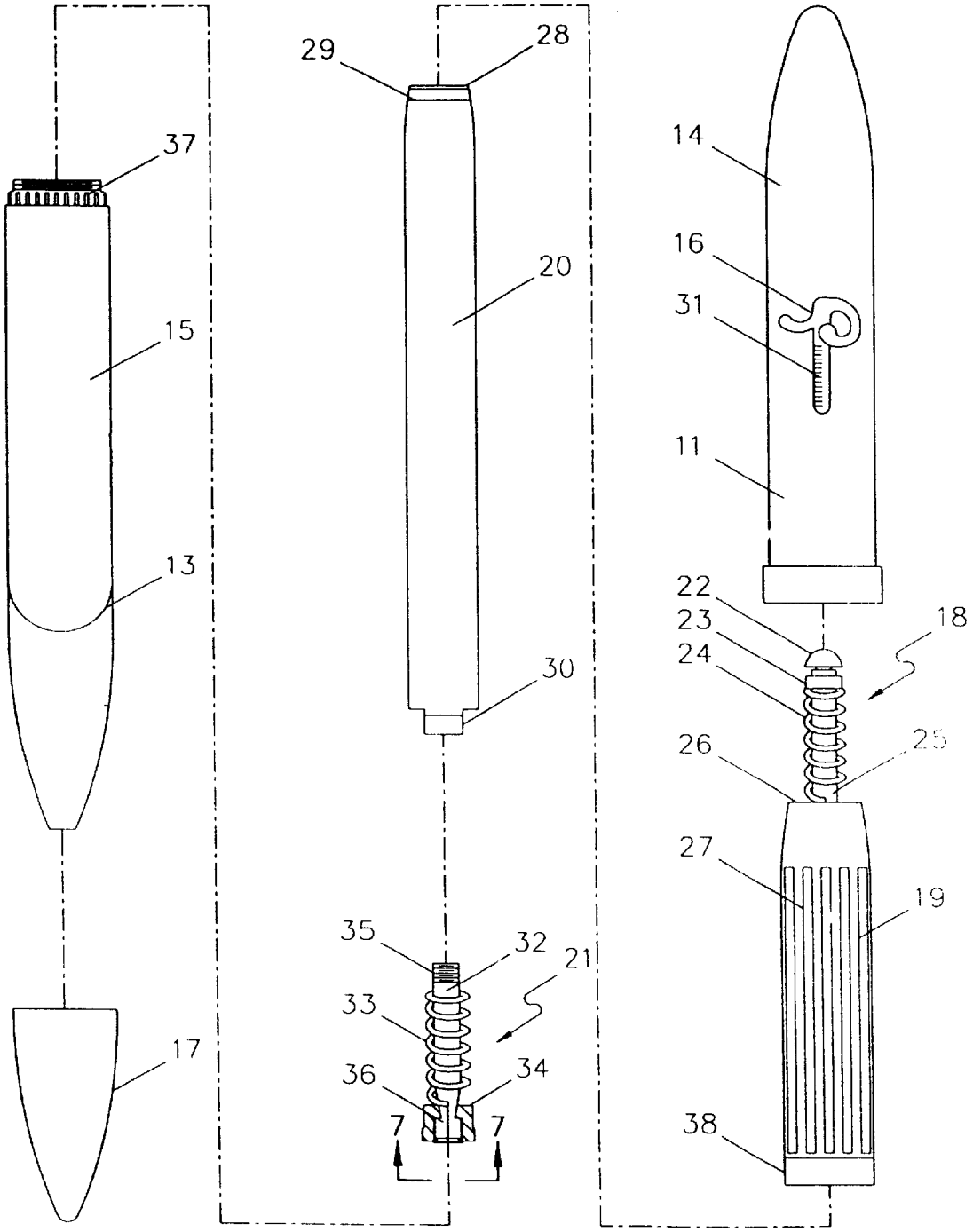
FIG. 3 is an exploded view of the nail polish applicator of FIG. 2, shown with an end cap.

Referring to the exploded view of FIG. 3, the applicator 10 comprises, from top to bottom, the upper housing section 14, a punch mechanism 18, a cartridge housing 19, a nail polish cartridge 20, a dispenser mechanism 21, the lower housing section 15, and a removable end cap 17. The end cap 17 is recommended. It fits closely over the bottom portion of the lower housing section 15 once the nail polish brush 12 has been retracted into the lower housing section. The end cap 17 may be indented, or have snaps, so that it forms an air tight seal on the lower housing section 15, yet is easily removed. The function of the end cap 17 is to prevent the nail polish brush 12 from drying out, and to keep any nail polish remaining on the brush or the end of the lower housing section from rubbing off onto another surface, such as the user's hands or the inside of a purse.

Continuing with FIG. 3, the upper housing section 14 covers: the punch mechanism 18, the cartridge housing 19, and an upper portion of the nail polish cartridge 20. The lower housing section 15 covers a lower portion of the cartridge 20, and the nail polish dispensing mechanism 21. The punch mechanism 18, which allows the user to control the discharge of nail polish from the cartridge 20 to the brush 12, comprises: a punch button 22, a punch cap 23, a punch spring 24, and a punch rod 25. The punch spring 24 is movably wrapped around the punch rod 25. An upper end of the punch rod 25 rests against the punch cap 23, and an opposite lower end of the punch rod extends down through an aperture in the upper end 26 of the hollow cartridge housing.

As shown in FIG. 3, the hollow, cylindrical cartridge housing 19 has vertically oriented, spaced apart, narrow ribs 27 on its exterior. These ribs 27 correspond with similar narrow vertical ribs along the inside of the upper housing section 14. The ribs on the outside of the cartridge housing fit between the ribs on the inside of the upper housing section, and vice versa. The ribs help to support the cartridge housing 19 when the upper housing section 14 is turned. The entire cartridge housing fits closely into the upper housing section 14. The interior of the cartridge housing preferably also comprises vertically oriented, spaced apart, narrow ribs which correspond to similar ribs on the exterior of the nail polish cartridge 20. These ribs serve to guide the cartridge into the cartridge housing. An alternative embodiment has no ribs on the cartridge housing or the upper housing section.

As is also shown in FIG. 3, the nail polish cartridge 20 fits closely into the cartridge housing 19. Although it may be fixed, it is preferably removable and replaceable. When the applicator 10 is in a closed position, with the nail polish brush inside, the upper end 28 of the nail polish cartridge 20 rests against the cartridge housing upper end 26. The bottom of the nail polish cartridge projects from the bottom of the cartridge housing 19 and adjoins the top of the dispenser mechanism 21. The nail polish cartridge most preferably includes small, narrow ribs extending vertically down approximately ½ to one inch from the top of the cartridge. Each rib fits between corresponding ribs on the interior of the cartridge housing. The ribs ensure that the nail polish cartridge fits properly into the cartridge housing. The lower end of the nail polish cartridge 20 comprises a collar 30 at the lower end of the cartridge 20.

A fill line 29 showing the nail polish level in the cartridge is shown in FIG. 3. When the nail polish cartridge is empty, or if a user wishes to change polish colors, the user can replace a used polish cartridge with a new one by pulling off the upper housing section 14, removing the used cartridge 20 from the cartridge housing 19 and replacing it with a new one. Used cartridges are disposable. Refill cartridges are available and a different color nail polish may be selected when the cartridge is replaced. Generally, nail polish cartridges herein contain 0.5 ounces, or 15 milliliters, of nail polish. The cartridge can hold various types of nail polish, including base coats and nail strengtheners, clear protective top coats, scented or unscented nail polish, and various polish colors, with or without glitter. A manicurist can, for example, keep separate cartridges in stock for repeat customers who request the same polish color each trip to the manicurist.

Referring to FIG. 3, the nail polish cartridge 20 and the cartridge housing 19 are preferably made of a sturdy, see-through plastic so that the color of the polish inside the cartridge is visible. Optionally, the color of the nail polish and the amount remaining in the cartridge can be ascertained by a user from the outside of the applicator by viewing the letter "P" 16 on the upper housing section 14. The vertical bar of the stylized "P" 16 is optionally a clear viewing window, preferably with gauge marks 31 along the side. The nail polish inside can be seen through the window of the stylized "P" 16, and the level 29 of the polish can be ascertained bay comparing the level of the polish showing through the window against the gauge marks 31. Various letter of the alphabet, designs, or logos can be used instead of a "P". Alternatively, a user may remove the upper housing section to determine the amount (or color) of nail polish remaining in the cartridge. It is recommended that a true color sample be displayed on the product packaging.

As illustrated in FIG. 3, the dispenser mechanism 21 comprises: a dispenser shaft 32, a dispenser spring 33, and a movable dispenser sheath 34. The dispenser spring 33 wraps around the dispenser shaft 32. The upper end 35 of the hollow dispenser shaft 31 is threadably engaged, preferably by screwing or snapping, to the collar 30 at the lower end of the cartridge 20. The lower end of the dispenser shaft 32 is divided, which forms a set of jaws 36. When the applicator is in a first, closed position, the movable sheath 34 extends from the lower end of the spring 33 down to the end of the jaws 36. Alternatively, when the applicator 10 is in a closed position, the movable sheath 34 extends around the dispenser spring 33 and the dispenser shaft 32 from the threaded upper end of the dispenser shaft to the lower end of the jaws 36. The jaws 36 cannot open when the dispenser sheath 34 is in place around them. Conversely, the jaws do open when the dispenser sheath is not in place over the jaw.

The lower portion of the nail polish cartridge 20 and the dispenser mechanism 21 fit into a lower housing section 15, as shown in FIG. 3. The number of disposable elements within the whole applicator may vary. First, if the dispenser shaft 32, or the rest of the dispenser mechanism 21, clogs or breaks, it can be pulled out of the lower housing section 15, unscrewed from the nail polish cartridge 20, and inexpensively replaced. A second alternative to the disposable dispenser mechanism is an applicator with a dispenser mechanism 21 that is affixed to the nail polish cartridge 20 and the whole dispenser/cartridge unit is disposable. A third, preferred alternative to the disposable dispenser mechanism is a permanently affixed dispenser mechanism 21 that is not removable or disposable, although the cartridge 20 can be removed by unscrewing it from the dispenser mechanism. In a fourth alternative, rather than) individual disposable elements, the entire applicator is disposable.

As shown in FIG. 3, the upper end of the lower housing section 15 is recessed and holds a rotatable band 37 having a series of short, vertically oriented grooves on the outside of the band. A band 38 on the lower end of the cartridge housing fits into grooves on the upper rotatable band 37. The cartridge housing 19, then, fits tightly over the band 37 on the upper end of the lower housing section 15. The cartridge housing 19 fits closely into the upper housing section 14. By grasping the upper housing section 14 with one hand and the lower housing section 15 with the other hand and twisting, a user can rotate the upper housing section clockwise or counterclockwise about these bands 37, 38, which are along the midline of the applicator. This action raises the nail polish brush 12 into the lower housing section 15, or lowers it for use. The band 37 is directly or indirectly connected to the drum housing 47 within the main housing 11, and is rotatable with the upper housing section 14. When the upper drum housing section 14 is rotated, the brush 12 is enabled to move between its first and second positions.

Figure 4:
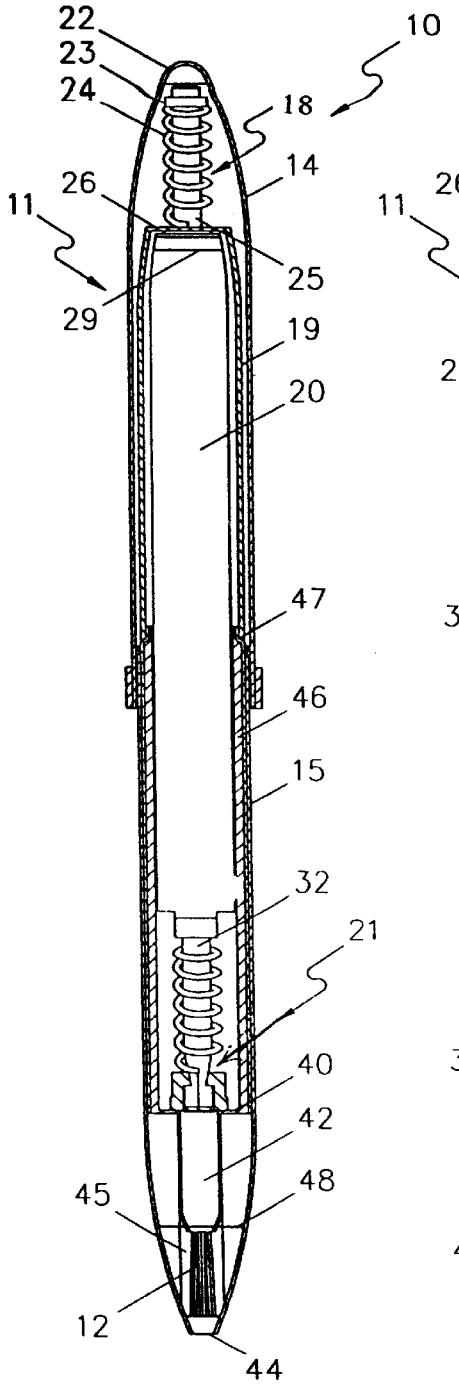
FIG. 4 is a longitudinal cross-sectional view of the nail polish applicator of FIG. 2, taken across line 3—3.
Figure 5:
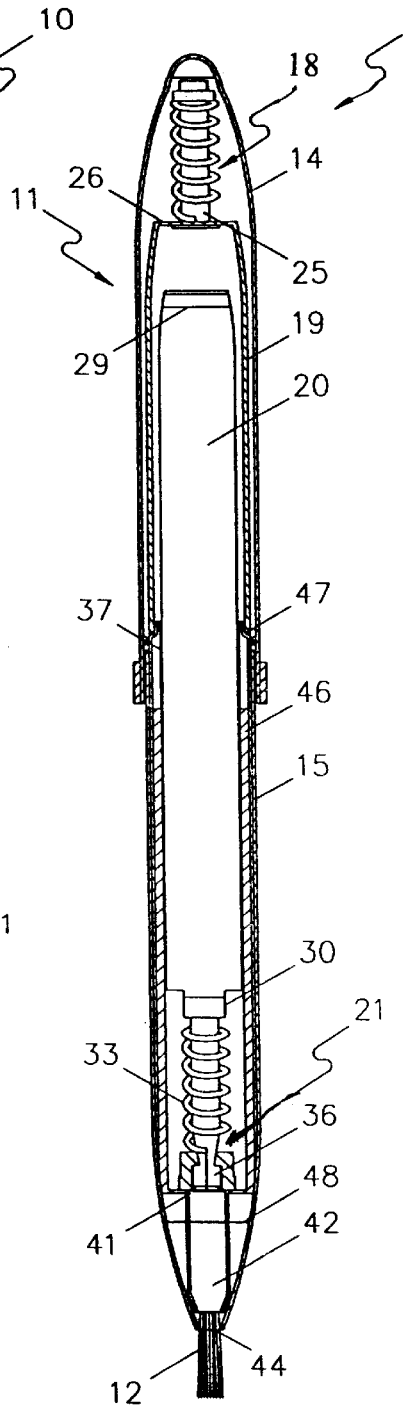
FIG. 5 is a cross-sectional view of the nail polish applicator according to FIG. 3, shown in an open position.
Figure 6:
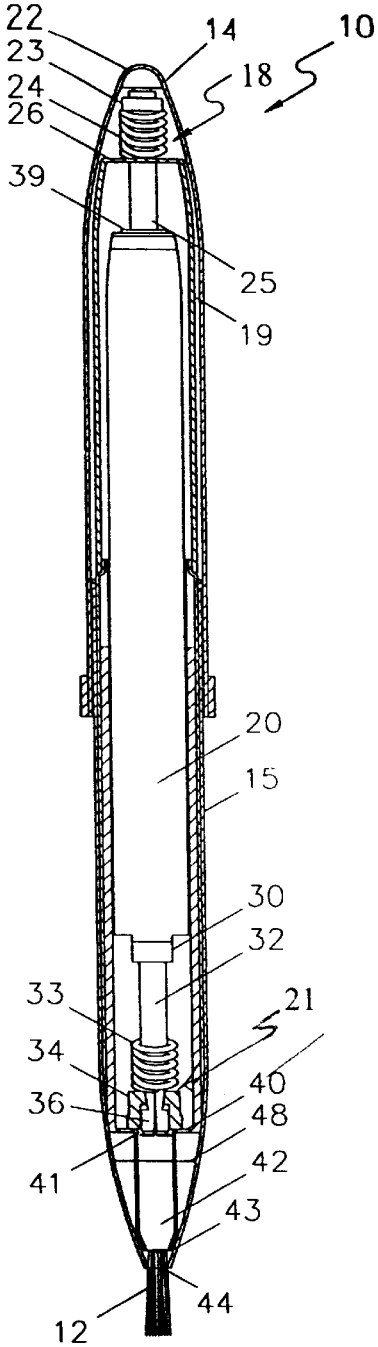
FIG. 6 is a cross-sectional view of the nail polish applicator according to FIG. 3, shown in an open, depressed position.
Figure 4B:
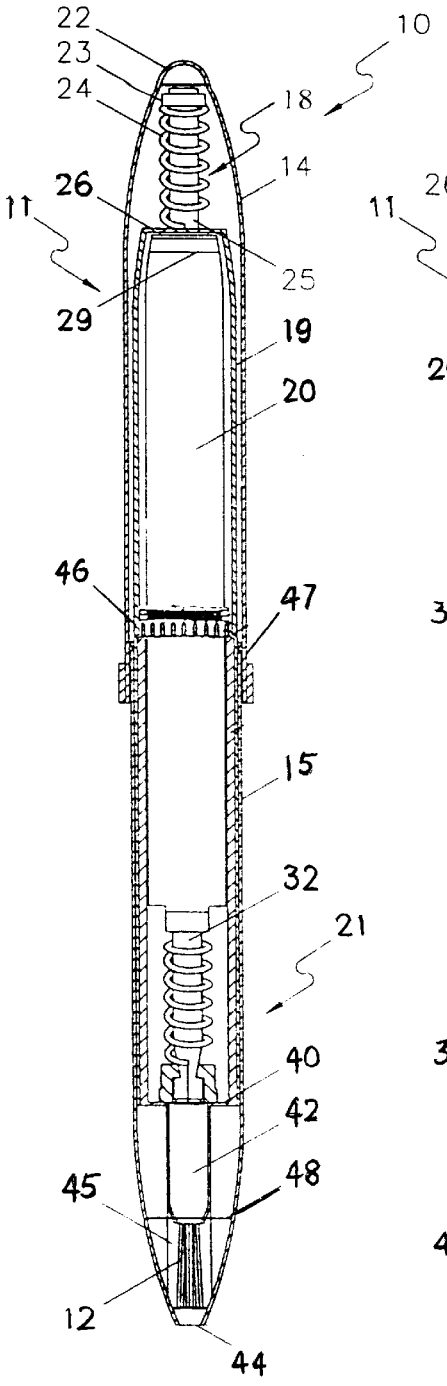
FIG. 4*b* is a longitudinal cross-sectional view of a nail polish applicator according to the present invention.
Figure 5B:
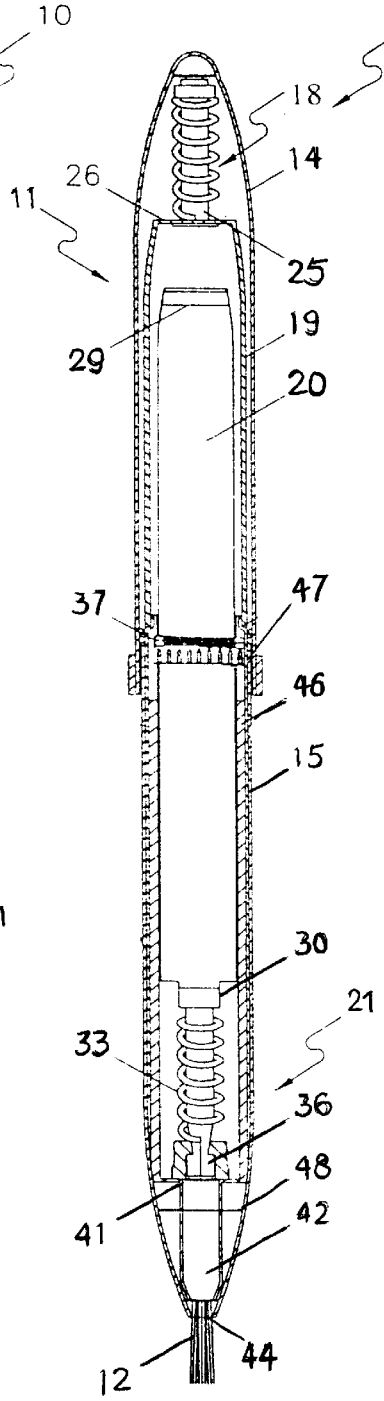
FIG. 5*b* is a longitudinal cross-sectional view of the nail polish applicator according to FIG. 4*b*, shown in an open position.
Figure 6B:
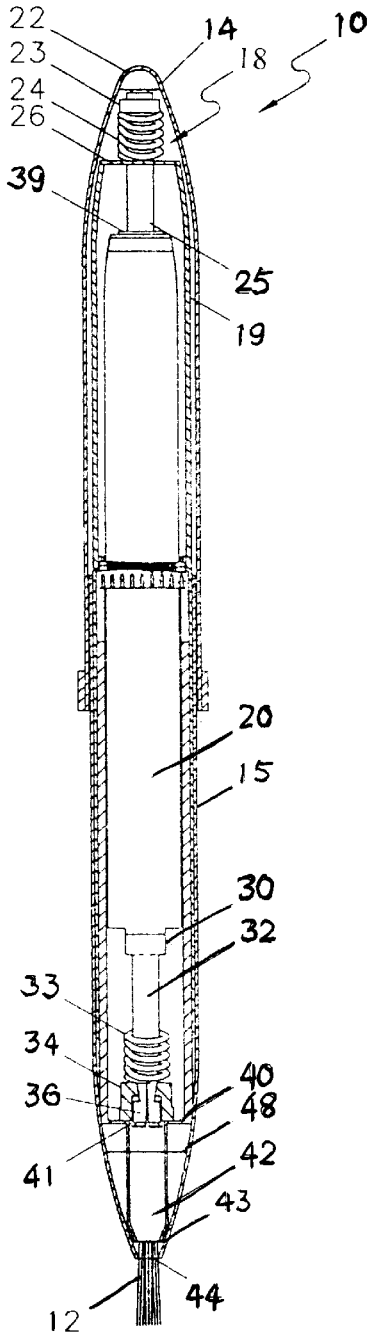
FIG. 6*b* is a longitudinal cross-sectional view of the nail polish applicator according to FIG. 4*b*, shown in an open, depressed position.
Figure 4C:
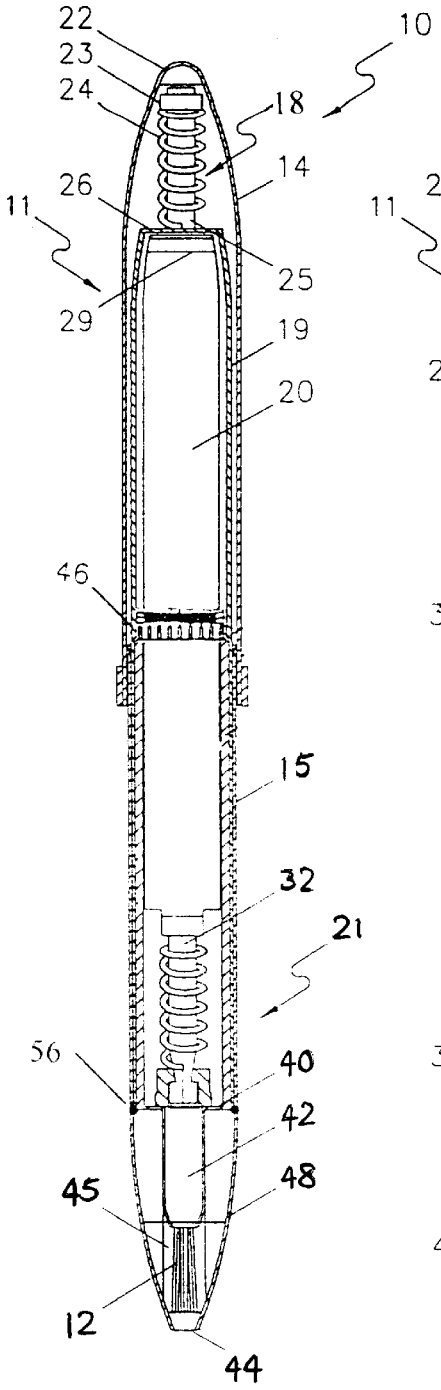
FIG. 4*c* is a longitudinal cross-sectional view of a nail polish applicator according to the present invention.
Figure 5C:
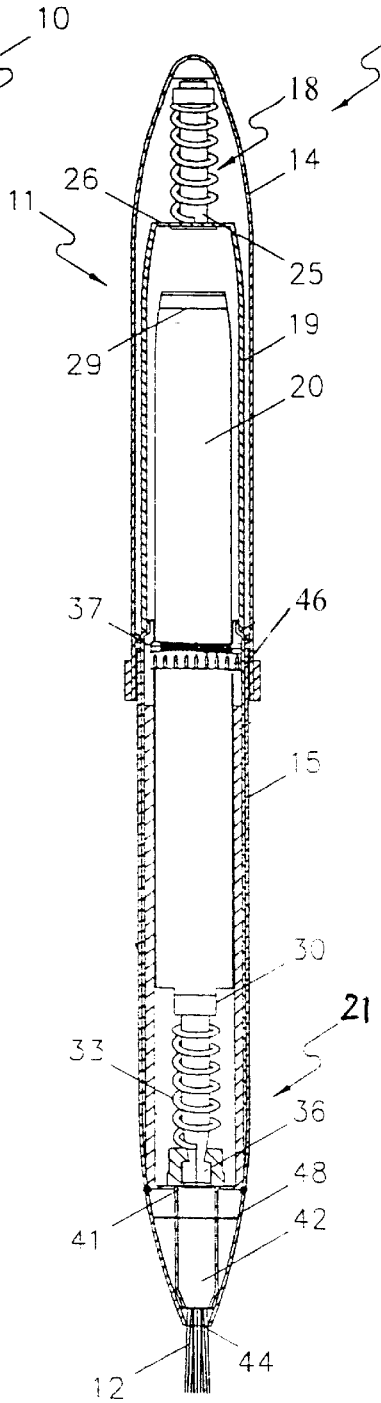
FIG. 5*c* is a longitudinal cross-sectional view of the nail polish applicator according to FIG. 4*c*, shown in an open position.
Figure 6C:
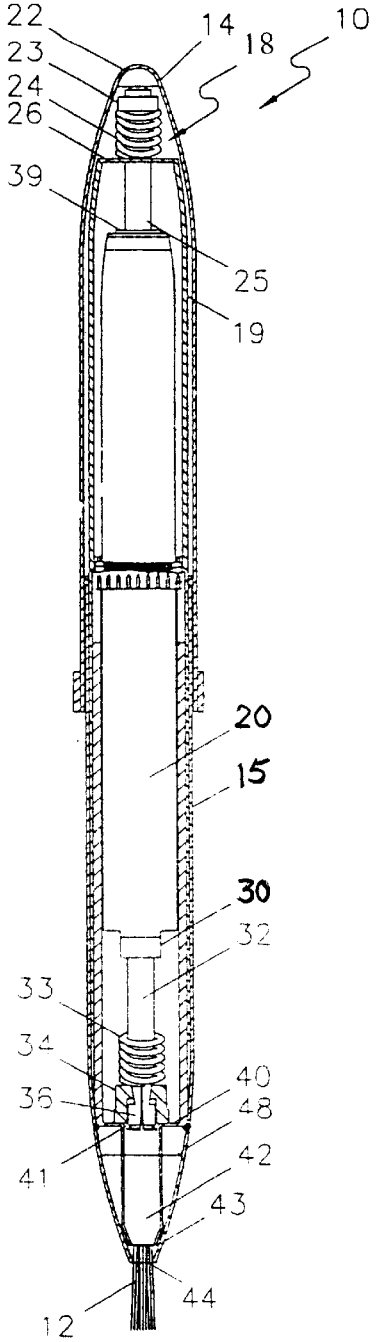
FIG. 6*c* is a longitudinal cross-sectional view of the nail polish applicator according to FIG. 4*c*, shown in an open, depressed position.

FIGS. 4 through 6 show cross-sections of an applicator 10 along its longitudinal axis at the centerline of the applicator. FIG. 4 shows the applicator 10 when it is not in use. In FIG. 5, the twist mechanism has been employed to lower the brush 12 from the aperture housing 44. As a result, the nail polish cartridge 20 is lower. In FIG. 6, the punch mechanism 18 has been punched, which causes nail polish to appeal on the brush. The punch mechanism 18 at the top of the applicator 10 is used to dispense nail polish onto the nail polish brush 12 once it has been lowered by twisting the applicator at the midsection.

Specifically, when a user pushes down on the upper housing section 14, or the top of the applicator, the punch button 22, which is adjacent to the inside top of the upper housing section, is depressed, as shown in FIG. 6. This applies pressure on the punch cap 23 and compresses the punch spring 24. The bottom of the punch spring 24 is compressed against the upper end 26 of the cartridge housing 19. Just inside the upper end 26 of the cartridge housing 19, the lower end of the punch rod 25 preferably flares out over the top of the cartridge 20. This punch rod flange 39 abuts the top of the cartridge housing. In an alternate embodiment, the punch cap and the punch button are one piece. Thus, the punch mechanism 18 comprises: the punch cap 23 and/or punch button 22, the punch spring 24, and the punch rod 25.

As shown in FIG. 6, when the punch rod 25 is depressed, the nail polish cartridge 20 is pushed downward. Since the dispenser mechanism 21 is rigidly attached to the lower end of the cartridge 20, the dispenser shaft 32 is pushed downward. The bottom edge of the dispenser sheath 34 abuts the top of a circular ridge 40 that extends outwardly from the inside wall of the applicator in a perpendicular direction. In the center of the ridge is a chamber opening 41 large enough for the jaws to fit through. When the dispenser mechanism is in a closed position, as shown in FIGS. 4 and 5, the jaws 36 are closed and do not extend through the chamber opening 41. When the dispenser mechanism is in an open position, as shown in FIG. 6, the jaws 36 are open and extend slightly into the chamber opening 41. The chamber, opening is at the top of a cylindrical brush chamber 42. A brush aperture 43 at the lower end of the brush chamber 42 opens to the nail polish brush 12. When the nail polish brush 12 is lowered, as shown in FIGS. 5 and 6, it extends through a housing aperture 44 in the bottom end of the lower housing section 15. When it is retracted, the brush 12 is stored within a hollow 45 in the lower portion of the lower housing section 15, as shown in FIG. 4. The housing aperture can optionally have a thin, flexible rubber gasket around its circumference to protect the bristles when the brush is retracted, and to limit the exposure of the bristles to air, which may cause them to harden.

Continuing with FIGS. 4 through 6, when the dispenser shaft 32 is pushed down, the dispenser spring 33 is compressed. The dispenser sheath 34 remains pressed against the ridge 40 and is drawn back as the jaws 36 thrust forward. The jaws 36 drop down slightly into the brush chamber, as shown in FIG. 6. The polish drips down from the cartridge into the hollow dispenser shaft 32. Since the dispenser sheath 34 is drawn back, the jaws 36 are no longer held closed. The jaws separate slightly, which allows a drop of nail polish to be emitted from the gap between the jaws. The drop of nail polish falls by gravity to the bottom of the brush chamber 42. The nail polish then drips through the brush aperture 43 at the bottom of the brush chamber 42 into the nail polish brush 12. Thus, a pre-determined amount of nail polish drips onto the bristles of the brush each time the user presses down on the top of the applicator. The brush bristles preferably surround the brush aperture 43, so that the polish is evenly distributed through the bristles. Also, the physical action of brushing the applicator's brush 12 on a nail draws the drops of polish down through the bristles.

The size of the space between the jaws 36, and the diameter of the brush aperture 43 are calibrated. This assures that the nail polish is emitted one drip at a time, and the amount of nail polish extruded to the brush 12 is enough to polish one or two nails, but is not so much that it drips off the end of the brush 12. However, the user is in control of the amount of nail polish emitted onto the brush. If the user desires a greater amount of nail polish, she or he can push down on the top of the applicator 10 more frequently, or push the top down and hold it momentarily. The brush bristles are evenly coated, and the user can achieve a thin, even coating on the nail, which dries more quickly and evenly. The small sized brush of the present applicator and less nail polish on the brush means more precise application is possible. There is no need to plunge a brush into a nail polish bottle, coming up with varying amounts of polish, or to wipe the brush on the neck of the polish bottle to clean it off. Spilling is also avoided.

The main housing of the applicator is preferably weighted slightly (a few ounces) to steady and balance the applicator in the user's hand. This facilitates nail polish application.

Continuing to refer to FIGS. 4 through 6, the position (first, and second; raised and lowered) of the brush 12 is controlled by rotation of the upper housing section 14. Inside the lower housing section 15 is a rotatable drum 46. The rotatable drum 46 is closely and slidably positioned in a rotatable drum housing 47, which fits closely inside the lower housing section 15 The brush is affixed to the end of the rotatable drum. The user twists the upper and lower housing sections relative to one another, which causes the rotatable drum to rotate inside the rotatable drum housing, as shown in FIGS. 4 and 5, which lowers or raises the brush 12, depending on the direction of the rotation (see below).

As shown in FIGS. 4 through 6, the ridge 40, which is horizontally positioned in comparison to the vertical orientation of the main housing 11, is continuous with, and extends in a perpendicular, inward direction from, the bottom of the rotatable drum 46. When the upper housing section is rotated, preferably in a clockwise direction, the rotating drum housing 47 also turns. This causes the rotatable drum 46 to move in a downward direction, which moves the brush 12 out through the housing aperture 44, as shown in FIG. 5. When the upper housing section 14 is turned in an opposite direction, usually counterclockwise, the rotatable drum housing 47 turns, and the rotatable drum 46 moves in an upward direction, which rotates the brush 12 back into the hollow 45 in the lower portion of the lower housing section 15, as shown in FIG. 4. The brush 12 is preferably kept inside the hollow 45 when it is not in use in order to keep the brush bristles clean and soft. It is recommended that the brush 12 be cleaned prior to retracting it. A removable end cap 17 for attachment over the housing aperture 44 is recommended (see FIG. 3).

The preferred embodiment shown in FIGS. 4–6 also comprises an O-ring 48 which encircles the inside of the lower housing section 15 at approximately the same level as the top of the retracted brush 12. The O-ring 48 provides a hollow for the brush to fit within. The O-ring allows the brush chamber to move up and down. The entire applicator is designed to provide an air tight environment for the nail polish. Nail polish contains certain solvents which easily evaporate into the ambient air when a container of nail polish is opened. Without meaning to be bound by theory, it is believed that the present applicator is relatively air tight, which helps to prevent the nail polish inside from hardening. This prevents clogging of apertures within the applicator and keeps the nail polish within the applicator from becoming thick and unusable. The nail polish within the present cartridges thus performs optimally for a longer period, and lasts a longer time inside the cartridge than nail polish in conventional nail polish containers.

In various forms of the invention, the cartridge 20 and dispenser shaft 32 are preferably made of a plastic material that is resistant to damage by solvents over time. Suitable plastic materials for use herein do not adhere to nail polish, so the nail polish is less likely to harden and stick to the walls of the dispenser shaft and cartridge. Most preferred for use herein is ultra high molecular weight polyethylene. The upper and lower housing sections can be made of plastic, metal (e.g., aluminum, stainless steel), or other suitable materials.

Figure 7:
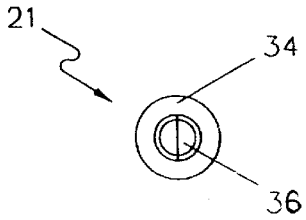
FIG. 7 is a latitudinal cross-sectional view of the nail polish applicator taken along line 7—7 of FIG. 3.
Figure 8:
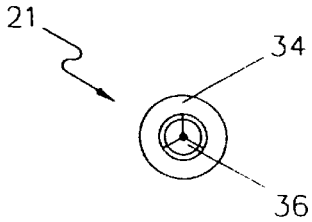
FIG. 8 is a latitudinal cross-sectional view of an alternate embodiment of the nail polish applicator of FIG. 3, taken along line 7—7.

Referring to FIGS. 7 and 8, the lower end of the dispenser shaft 32 can be divided into two parts, forming two jaws 36, as shown in FIG. 7. Three jaws are alternatively formed where the dispenser shaft has been divided into three parts, as shown in FIG. 8. FIGS. 7 and 8 show alternate embodiments, as viewed from outside the jaws looking in. The jaws 36 are shown in a closed position and are surrounded by the dispenser sheath 34 in FIGS. 7 and 8. The end of the dispenser shaft may be divided to form other shapes, such as multiple divisions forming a star-shaped opening. Alternatively, the jaws can be a separate component attached to the lower end of the dispenser shaft, rather than being formed by a split in the end of the dispenser shaft.

Thus, the applicator 10 includes: (a) an elongated, hollow, generally pen-shaped main housing 11 having an aperture at one axial extremity; (b) an elongated cartridge housing disposed within an upper portion of the main housing; (c) a nail polish cartridge comprising a central chamber for holding a supply of liquid nail polish, the nail polish cartridge having a first, upper end and an opposite, second, lower end, the cartridge being disposable within the cartridge housing 19; (d) a brush 12 having a plurality of bristles for applying nail polish; (e) a mechanism 21 for dispensing nail polish from the nail polish cartridge in increments; and (f) a mechanism for controlling the discharge of nail polish from the nail polish cartridge onto the brush 12. The nail polish dispensing mechanism has a first position in which nail polish is contained within the cartridge and is not dispensed, and a second position in which nail polish is dispensed from the cartridge through the housing aperture onto the brush 12.

The brush 12 is preferably mounted for axial movement between a first position inside the lower housing section 15, as shown in FIG. 4, and a second position extending from the lower housing section 15, as shown in FIG. 5. The applicator 10 preferably includes: a rotatable mechanism for axially translating the brush 12 between the first position within the lower housing section 15, and the second position extending outside the lower housing section. The rotatable mechanism for axially translating the brush most preferably includes a rotatable drum 46 within a rotatable drum housing 47 disposed within the lower housing section 15.

Figure 3B:
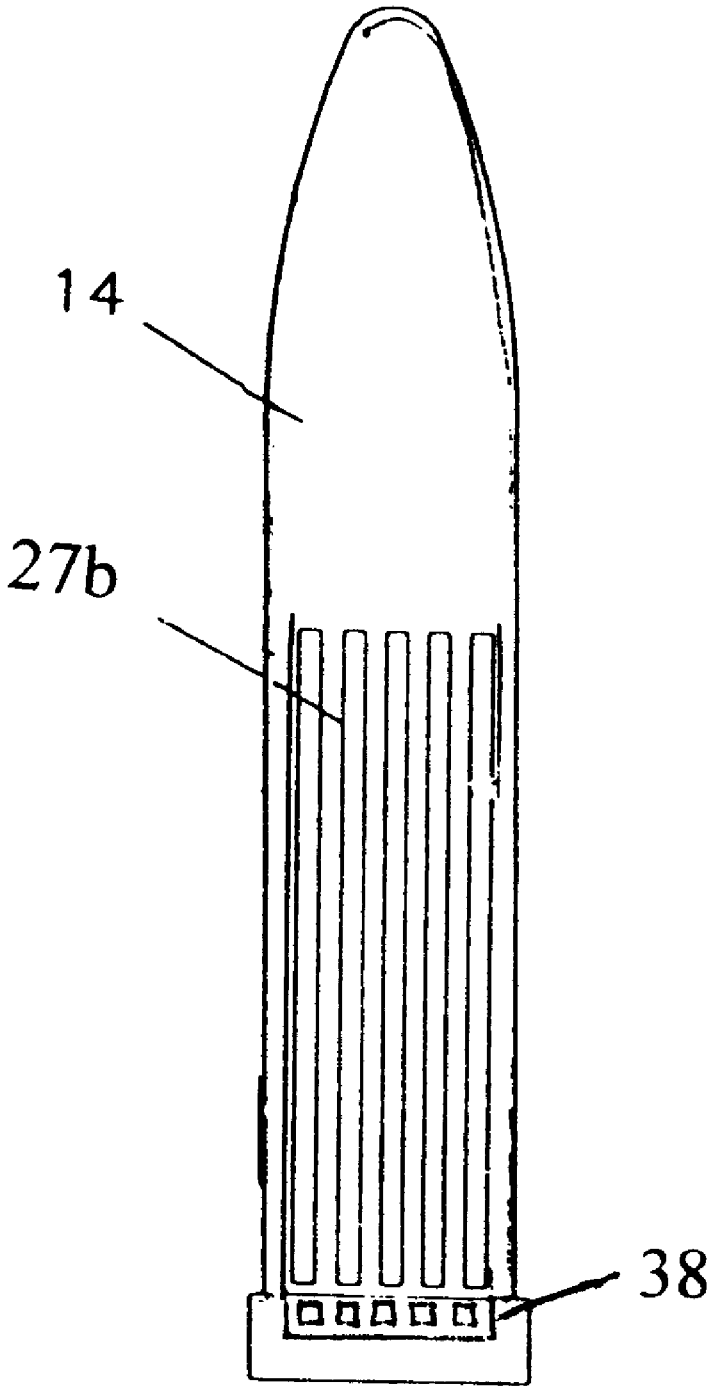
FIG. 3*b* is a longitudinal cross-sectional view of an upper housing of a nail polish applicator according to the present invention.

The nail polish cartridge 20 is at least partially disposed within the cartridge housing 19, the cartridge housing 19 is disposed within the upper housing section 14, and the lower housing section 15 houses the dispensing mechanism 21, and the brush 12 when the brush 12 is in the first position. The cartridge housing 19 preferably has vertically oriented, spaced apart ribs 27 on its outer surface, as shown in FIG. 3, which correspond to similar ribs 27*b* along the inside surface of the upper housing section 14, as shown in FIG. 3*b*. At least one, most preferably all, of the ribs 27 on the cartridge housing 20 fits between at least one, most preferably all, of the ribs on the upper housing section 14.

Regarding (f) above, the control mechanism preferably includes a button or lever that is accessible to a user. A preferred mechanism for controlling the discharge of nail polish from the nail polish cartridge 20 is a punch mechanism 18 having a first position in which nail polish is not dispensed, as shown in FIG. 4, and a second position in which nail polish is dispensed from the nail polish cartridge 20 onto the brush 12, as shown in FIG. 6. The punch mechanism 18 preferably includes: (1) a punch cap 23 or punch button 22 in contact with an upper end of the main housing 11; (2) a punch rod 25 having an upper end and an opposite lower end; and (3) a punch spring 24 wrapped around at least a portion of the punch rod 25, as shown in FIGS. 4 through 6. A lower end of the punch spring 24 contacts an upper end of the cartridge housing 19, as shown in FIGS. 4–6. The upper end of the punch rod 25 contacts the punch cap 23 or punch button 22, and the lower end of the punch rod 25 contacts an upper end of the nail polish cartridge 20.

A preferred nail polish dispenser mechanism includes: (1) a hollow dispenser shaft 32; (2) a dispenser spring 33 movably wrapped around the dispenser shaft 32; and (3) a movable sheath 34 closely encircling at least a lower end of the dispenser shaft, as illustrated in FIGS. 4–6. An upper end of the dispenser shaft 32 is adapted for joining with a lower end 30 of the nail polish cartridge 20, and a lower end of the dispenser shaft 32 is divided to form a set of jaws 36.

Figure 9:
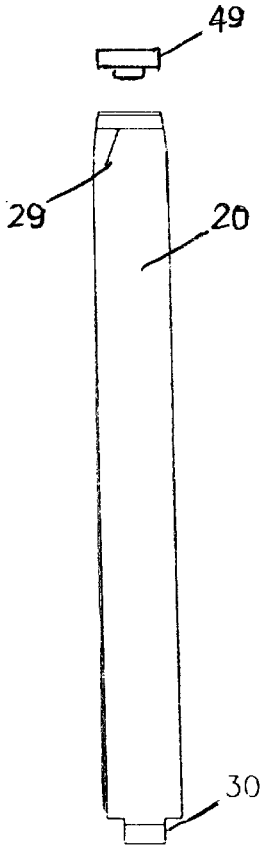
FIG. 9 is a front elevational view of an alternate embodiment of a nail polish cartridge according to the present invention.

Referring to FIG. 9, an alternate embodiment of the nail polish cartridge 20 is illustrated. Here, the removable cartridge 20 is refillable rather than being disposable. Thus, the nail polish cartridge can be either replaceable and disposable, as shown in FIGS. 4–6, or refillable, with a detachable cap at its upper end, as shown in FIG. 9.

To refill, the cartridge cap 49 is removed from the cartridge 20, as shown in FIG. 9. The cartridge cap 49 can screw or snap into an aperture at the top of the cartridge. A small funnel (not shown) can be used to fill the cartridge with nail polish from a supply bottle. The refillable cartridge is advantageous in that the user can pour only enough nail polish into the cartridge to do the job at hand. For example, a customer whose fingernails were recently polished may have marred the nail polish on one or two of her nails. The present invention enables the manicurist to pour only enough polish into the refillable cartridge to replace the polish on those nails. There is thus less wasted nail polish. Another benefit of the refillable cartridge is that the user can choose her favorite nail polish brand or color to pour into the nail polish cartridge.

Figure 10:
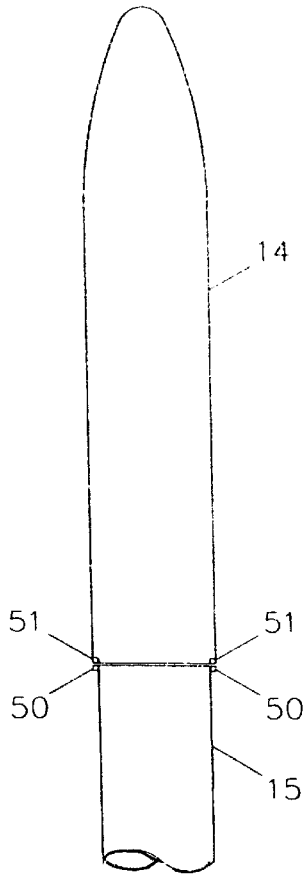
FIG. 10 is a longitudinal cross-sectional view of an alternate embodiment of a nail polish applicator, showing a locking mechanism.

Referring to FIG. 10, an alternate embodiment of the applicator 10 includes a locking mechanism. For the purpose of illustration, a simplified upper portion of the applicator is shown. The locking mechanism can be used to fix the upper housing section 14 in place when the applicator 10 is not in use. When the applicator is in a locked position, the upper housing section 14 will not descend. Polish will therefore not be dispensed, or leak out, when the applicator is in a locked position. This minimizes chances that the applicator will leak, for example, when it is placed in a purse, or when a young child attempts to push in the top. The locking mechanism is comprised of lower lock tabs 50, which project outwardly from the outside of the upper portion of the lower housing section 15 just below the band 37. There are preferably two lower lock tabs 50 at the same location on opposite sides of the applicator 10. The locking mechanism also includes two corresponding upper lock tabs 51, which extend inwardly from the inside of the lower portion of the upper housing section 14, as shown in FIG. 10.

As shown in FIG. 10, when the lower lock tabs 50 are aligned with the upper lock tabs 51, the tabs prevent the upper housing section 14, which extends closely over the cartridge housing 19, from being moved in a downward direction, so the applicator 10 is locked. To unlock the applicator, a user turns the upper housing section 14 a quarter turn or so clockwise or counterclockwise. This moves the upper lock tabs 51 out of alignment with the lower lock tabs 50. When the applicator is thereby unlocked, the upper housing section can be depressed, which causes polish to be dispensed.

The applicator herein can be adapted for use by young girls or pre-teens by enlarging the housing somewhat. For example, a preferred embodiment of an applicator for use by an adult has an upper housing section midsection with a diameter of between about ¼ and ½ inch, while the upper housing section of an applicator for use by younger girls can have a diameter of between about ½ and ¾ inch. Applicators for the younger market are preferably substantially clear or translucent, or brightly colored.

Figure 11:
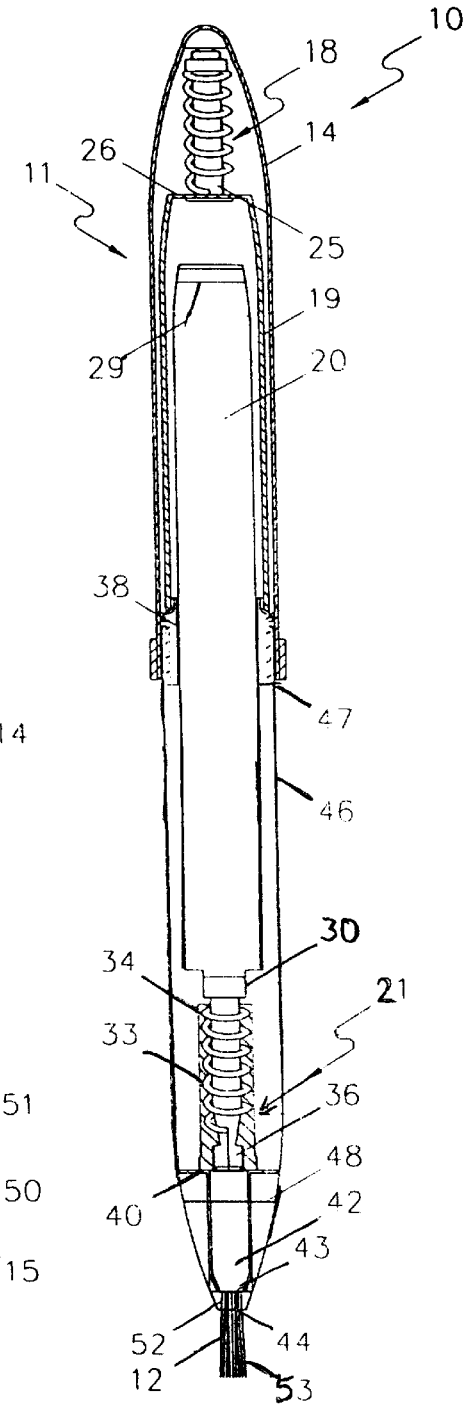
FIG. 11 is a longitudinal cross-sectional view of an alternate embodiment of a nail polish applicator according to the present invention.

Referring to FIG. 11, an alternate embodiment, which is disposable and particularly well-suited for the youth market, has a punch mechanism 18 and a dispenser mechanism 21, but no rotating mechanism for causing the brush 12 to ascend and descend. In this embodiment, there is no separate rotatable drum or rotatable drum housing. Instead of twisting the upper housing section to align the upper and lower lock tabs, in this simplified embodiment the entire upper housing section is detached and replaced in an aligned position to lock the applicator for use. Conversely, to unlock the applicator for use, the upper housing section is replaced so that the upper and lower lock tabs are not aligned. Since the brush does not move up and down in this embodiment, there is no need for an O-ring, hollow in the lower portion of the lower housing section, or aperture in the housing for the brush to fit through. Therefore, the lower housing section is greatly simplified. The ridge 40 extends from opposite sides of the lower housing section 15 toward the center of the applicator 10. For this embodiment, the punch mechanism 18 and dispenser mechanism 21 are as described herein.

Continuing to refer to FIG. 11, the bristles of the brush 12 have a first end 52 mounted in the main housing 11, and an opposite, second end which is a free end 53, as in previous embodiments described herein. In any embodiment, the applicator 10 may include a dispenser sheath 34 which extends the length of the dispenser shaft 32 from the bottom of the jaws 36 to just under the collar 30 of the cartridge 20, which is where the dispenser shaft 32 attaches to the cartridge 20. This cylindrical sheath 34, which is shown in FIG. 11, is longer than the dispenser sheath shown in FIGS. 4–6, and movably extends outside the dispenser spring 33.

Figure 12:
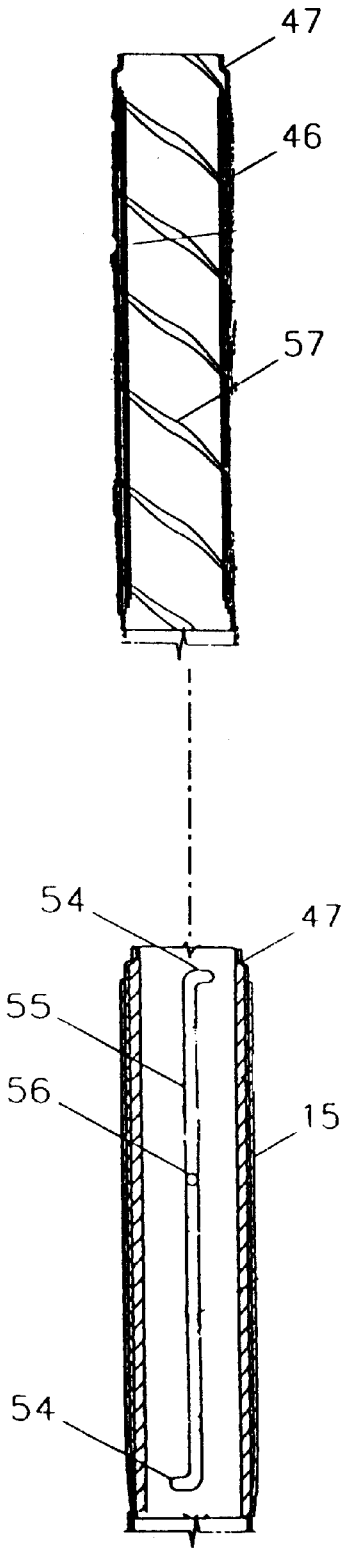
FIG. 12 is a longitudinal cross-sectional view of a portion of a lower housing section of a nail polish applicator according to the present invention.
Figure 13:
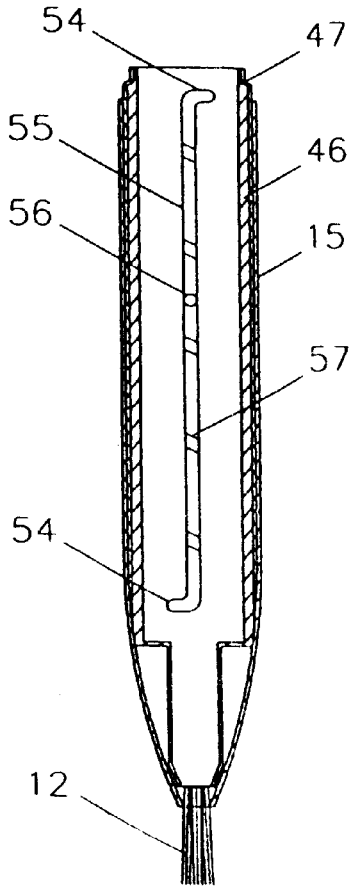
FIG. 13 is a longitudinal cross-sectional view of a portion of a lower housing section of a nail polish applicator according to the present invention.

Referring to FIGS. 12 and 13, the rotation mechanism allows a user to lower the brush 12 from inside the lower housing section 15 by twisting the upper and lower housing sections 14, 15 in opposite directions. In a preferred embodiment of the applicator 10, the rotation mechanism comprises the rotatable drum housing 47 in the rotatable drum 46 (see FIGS **4*b*–6*b*), which is located in the lower housing section 15. The rotatable drum housing extends substantially the length of the lower housing section and has a hollow for the brush in its lower portion. The lower housing section has along its inside wall a swirled, indented track 57 that spirals around and down the inside wall, as shown in cross-section in FIG. 12. The rotatable drum comprises two straight, vertical, cut-out tracks 55 extending down on opposite sides. The straight track 55 curves and has a deadend 54 at the top and bottom of each straight track, as shown in FIG. 13. The rotatable drum housing has two small button projections 56, which project through the straight, vertical cut-out tracks 55 from opposite, exterior sides of the rotatable drum. The brush 12 is attached to the lower end of the rotatable drum housing. Each button projection 56 projects through a straight rack 55. The unattached ends of the button projections extend through the two straight, vertical tracks on either side of the rotatable drum and into the swirled track 57 in the wall of the lower housing. When the rotatable drum is rotated, the rotatable drum housing moves up and down the straight tracks 55 in the rotatable drum. The button projections 56 moving along the swirled track in the lower housing causes the rotatable drum to revolve, or rotate. This causes the brush 12 to move in and out of the lower housing section 15. At the bottom or top of each straight track 55, each button projection 56 locks into the deadend 54, as shown in FIG. 13. This locks the brush 12** into place.

An alternate embodiment shown in FIGS. **4*c* through 6*c* does not include a rotatable drum housing. In this case, button projections 56 project through opposite sides of the rotatable drum The buttons extend from the ridge 40 through a straight track 55 in the rotatable drum 46**. The unattached ends of the button projections extend into the swirled, indented track on either side of the inside wall of the lower housing. When the drum is rotated, the buttons move up and down the straight tracks in the drum using the swirled track in the wall of the lower housing to move when turned.

Another alternate embodiment with a rotatable drum housing includes one button projection 56, rather than two, on the outside of the rotatable drum 46, a single swirled track 57 in the rotatable drum housing 47, and no straight track. The button projection projects into and moves along the single swirled, cut-out track 57. The rotatable drum housing 47 moves up and down within the rotatable drum 46 as the button projection 56 moves along the swirled track. This causes the brush 12, which is attached to the lower end of the rotatable drum housing, to rotate in and out of the applicator.

From this description, it is obvious that the applicator can be held with one hand for an entire nail painting sequence. The applicator is ready for use on the nails as soon as the end cap is removed and the brush is extended.

Figure 14:
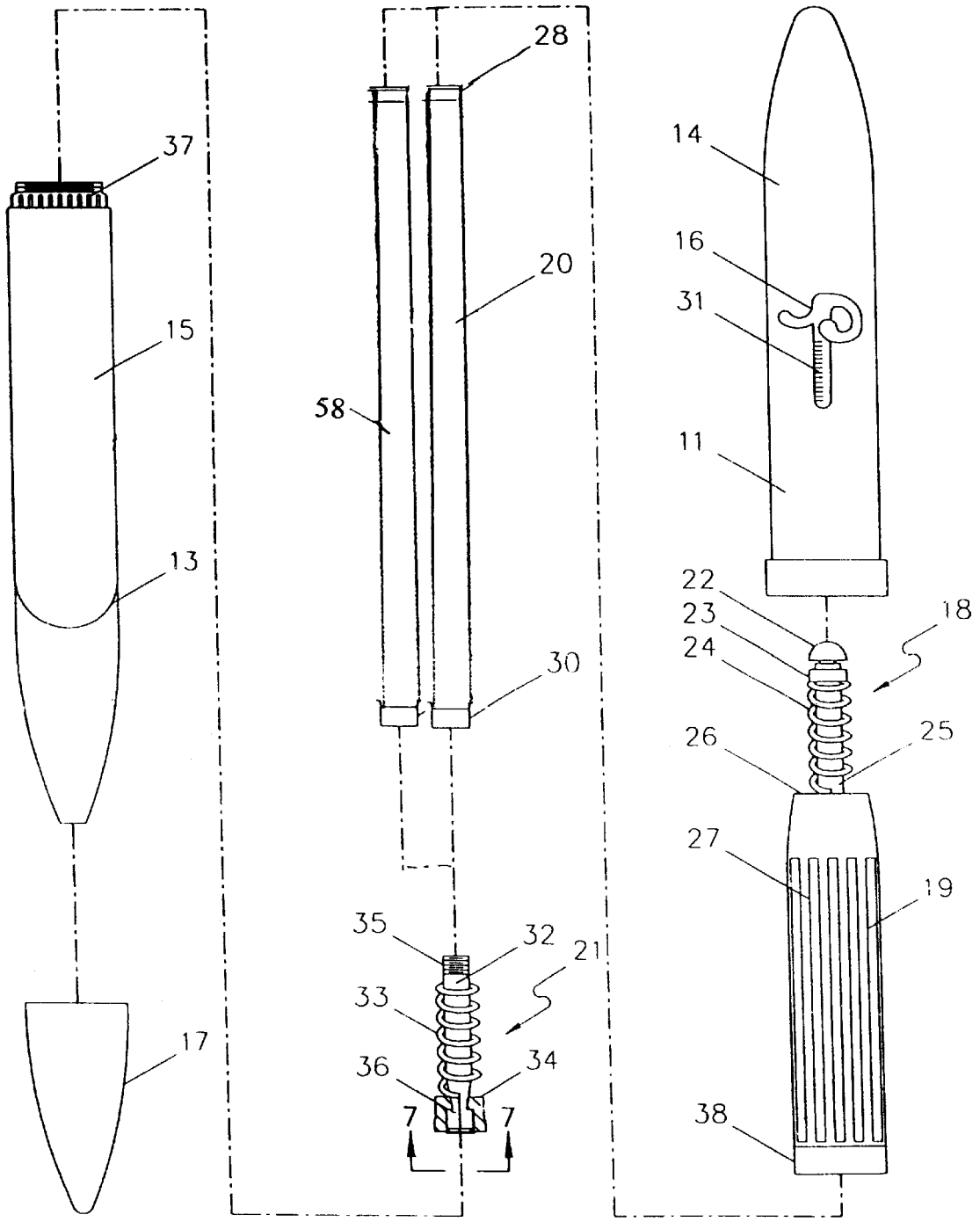
FIG. 14 is an exploded view of an alternate embodiment of a nail polish applicator according to the present invention, showing a polish remover reservoir.

Another alternate embodiment, as shown in FIG. 14, further includes a reservoir 58 for holding nail polish remover within the main housing 11, and a mechanism for stopping the flow of nail polish and dispensing the nail polish remover, so that the nail polish remover is supplied to the nail polish brush instead of the nail polish. This user-controlled option is useful for repairing a botched polish job on a nail (e.g., polish that has smeared over the nail cuticle), and for cleaning the brush after a nail polish job (e.g., after finishing with a manicure customer). The reservoir is preferably below the nail polish cartridge, and may be a division of the nail polish cartridge. Any type of liquid nail polish remover, including acetone, is suitable for use in the reservoir. The reservoir must be made of a material which is resistant to the effects over time of the nail polish remover contained in it.

One embodiment of this applicator with both nail polish and remover has a separate dispenser mechanism attached to the outside of the main housing, with a detachable, replaceable sponge end. An alternative embodiment of the applicator with both polish and remover accommodates two separate side-by-side or end-to-end removable cartridges, one for holding nail polish and one for holding nail polish remover. Rotation of the upper housing section clockwise or counterclockwise by the user determines which cartridge is tapped. Alternatively, two or more movable slide buttons on the exterior of the applicator can be moved to cause whichever cartridge is desired for use to slide into place for use. In the latter embodiment, each narrow cartridge would hold a different nail polish color, or polish remover. Each color-coded slide button would activate one cartridge.

From the foregoing it can be realized that the described device of the present invention may be easily and conveniently utilized as a nail polish applicator. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An applicator for dispensing and applying nail polish, the applicator comprising:

(a) an elongated, hollow, generally pen-shaped main housing having all aperture at one axial extremity;

(b) an elongated cartridge housing disposed within an upper portion of the main housing;

(c) at least one nail polish cartridge comprising a central chamber for holding a supply of liquid nail polish, the nail polish cartridge having a first, upper end and an opposite, second, lower end, the cartridge being disposable within the cartridge housing;

(d) a brush having a plurality of bristles for applying nail polish, each bristle having a first end mounted in the main housing and an opposite, second end which is a free end;

(e) a mechanism for dispensing nail polish from the nail polish cartridge in increments, the nail polish dispensing mechanism having a first position in which nail polish is contained within the cartridge and is not dispensed, and a second position in which nail polish is dispensed from the cartridge through the housing aperture onto the brush;

(f) a mechanism for controlling the discharge of nail polish from the nail polish cartridge onto the brush; and (g) a rotatable mechanism for axially translating the brush between the first position within the lower housing section, and the second position extending outside the lower housing section;

wherein the main housing comprises an alongated upper housing section having an opening at one axial extremity, and a lower housing section having an opening at one axial extremity, the upper and lower housing sections being detachably joined together at the openings; the brush being mounted for axial movement between a first position inside the lower housing section, and a second position extending from the lower housing section;

wherein a band connectable to a drum housing within the main housing is rotatable with the rotatable upper housing section; the brush being movable between the first and second positions with rotation of the upper housing section; and wherein the nail polish cartridge is at least partially disposed within the cartridge housing, the cartridge housing is disposed within the upper housing section, and the lower housing section houses the dispensing mechanism, and the brush in the first position.

2. A nail polish applicator according to claim 1, wherein the mechanism for controlling the discharge of nail polish from the nail polish cartridge comprises a punch mechanism having a first position in which nail polish is not dispensed, and a second position in which nail polish is dispensed from the nail polish cartridge onto the brush.

3. A nail polish applicator according to claim 2, wherein the punch mechanism comprises: (1) a punch cap or punch button in contact with an upper end of the main housing; (2) a punch rod having an upper end and an opposite lower end, the upper end of the punch rod contacting the punch cap or punch button, the lower end of the punch rod contacting an upper end of the nail polish cartridge; and (3) a punch spring wrapped around at least a portion of the punch rod, a lower end of the punch spring contacting an upper end of the cartridge housing.

4. A nail polish applicator according to claim 1, wherein the outside surface of the cartridge housing comprises vertically oriented, spaced apart ribs which correspond to similar ribs along the inside surface of the upper housing section, and wherein at least one of the ribs on the cartridge housing fits between at least one of the ribs on the upper housing section.

5. A nail polish applicator according to claim 1, wherein the nail polish cartridge is replaceable and disposable.

6. A nail polish applicator according to claim 5, wherein the mechanism for controlling the discharge of nail polish from the cartridge comprises a button accessible to a user.

7. A nail polish applicator according to claim 1, wherein the nail polish cartridge is refillable and comprises a detachable cap at its upper end.

8. An all-in-one applicator for dispensing and applying nail polish comprising:

(a) an elongated, hollow, generally pen-shaped main housing having an aperture at one axial extremity;

(b) an elongated cartridge housing disposed within an upper portion of the main housing;

(c) at least one nail polish cartridge comprising a central chamber for holding a supply of liquid nail polish, the nail polish cartridge having a first, upper end and an opposite, second, lower end, the cartridge being disposable within the cartridge housing;

(d) a brush having a plurality of bristles for applying nail polish, each bristle having a first end mounted in the main housing and an opposite, second end which is a free end;

(e) a mechanism for dispensing nail polish from the nail polish cartridge in increments, the nail polish dispensing mechanism having a first position in which nail polish is contained within the cartridge and is not dispensed, and a second position in which nail polish is dispensed from the cartridge through the housing aperture onto the brush; the nail polish dispenser mechanism comprising: (1) a hollow dispenser shaft; (2) a spring movably wrapped around the dispenser shaft; and (3) a movable sheath closely encircling at least a lower end of the dispenser shaft; wherein an upper end of the dispenser shaft is attachable to a lower end of the nail polish cartridge, and a lower end of the dispenser shaft is divided to form a set of jaws; and (f) a mechanism for controlling the discharge of nail polish from the nail polish cartridge onto the brush:

wherein a band connectable to a drum housing within the main housing is rotatable with an upper section of the main housing; the brush being enabled to extend or retract by rotation of the upper housing section.

9. A nail polish applicator according to claim 1, wherein the rotatable mechanism for axially translating the brush comprises a rotatable drum within the rotatable drum housing, the rotatable drum housing being disposed within the lower housing section.

10. A nail polish applicator according to claim 9, wherein the rotatable drum housing comprises two button projections projecting from opposite sides of the rotatable drum housing through straight, generally vertical cut-out tracks in the rotatable drum, the brush being affixed to a lower end of the rotatable drum housing; and wherein the lower housing section comprises a swirled, indented track spiraling down along its inside wall, each button projection having an end which movably projects through one of the straight tracks into the swirled track for guiding the rotatable drum housing down or up within the rotatable drum.

11. A nail polish applicator according to claim 10, wherein the rotatable drum further comprises two substantially identical straight tracks on its opposite sides, and wherein each button projection extends through a straight track and into the swirled track.

12. A nail polish applicator according to claim 9, wherein the rotatable drum comprises a button projection projecting from an upper end of the rotatable drum, the brush being affixed to a lower end of the rotatable drum; and wherein the rotatable drum housing comprises a swirled, indented track spiraling down along its inside wall, the button projection having an unattached end which movably projects into the swirled track and guides the rotatable drum down or up within the rotatable drum housing.

13. An all-in-one nail polish applicator, comprising:

(a) an elongated, hollow, generally pen-shaped main housing having an aperture at one axial extremity; the main housing being comprised of an elongated upper housing section having an opening at one axial extremity, and a lower housing section having an opening at one axial extremity, the upper and lower housing sections being detachably joined together at the openings;

(b) an elongated cartridge housing disposed within an upper portion of the main housing;

(c) at least one nail polish cartridge comprising a central chamber for holding a supply of liquid nail polish, the nail polish cartridge having a first, upper end and an opposite, second, lower end, the cartridge being disposable within the cartridge housing;

(d) a brush having a plurality of bristles for applying nail polish, each bristle having a first end mounted in the main housing and an opposite, second end which is a free end;

(e) a mechanism for dispensing nail polish from the nail polish cartridge in increments, the nail polish dispensing mechanism having a first position in which nail polish is contained within the cartridge and is not dispensed, and a second position in which nail polish is dispensed from the cartridge through the housing aperture onto the brush;

(f) a mechanism for controlling the discharge of nail polish from the nail polish cartridge onto the brush; and (g) a locking mechanism comprised of: at least two lower lock tabs, which project outwardly from the outside of an upper portion of the lower housing section; and at least two corresponding upper lock tabs, which extend inwardly from the inside of a lower portion of the upper housing section; wherein, when the lower lock tabs are aligned with the upper lock tabs, the lock tabs prevent the upper housing section from being moved in a downward direction;

wherein a band connectable to a drum housing within the main housing is rotatable with the rotatable upper housing section; the brush being enabled to extend or retract by rotation of the upper housing section.

14. A nail polish applicator according to claim 1, further comprising a reservoir for holding nail polish remover within the main housing adjacent to the nail polish cartridge.

* * * * *